US011628543B2

(12) United States Patent
Wang

(10) Patent No.: US 11,628,543 B2
(45) Date of Patent: Apr. 18, 2023

(54) OPEN-CLOSE HANDHELD APPARATUS AND METHOD OF ADJUSTMENT OF ANGLE BETWEEN HANDHELD PORTIONS THEREOF

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Min Wang, Hangzhou (CN)

(73) Assignees: HANGZHOU GREAT STAR INDUSTRIAL CO., LTD., Hangzhou (CN); HANGZHOU GREAT STAR TOOLS CO., LTD., Hangzhou (CN)

( * ) Notice: Subject to any disclaimer, the term of this patent is extended or adjusted under 35 U.S.C. 154(b) by 970 days.

(21) Appl. No.: 16/469,563

(22) PCT Filed: Dec. 14, 2016

(86) PCT No.: PCT/CN2016/109938

§ 371 (c)(1),
(2) Date: Jun. 13, 2019

(87) PCT Pub. No.: WO2018/107399

PCT Pub. Date: Jun. 21, 2018

(65) Prior Publication Data

US 2019/0389037 A1 Dec. 26, 2019

(51) Int. Cl.

| | |
|---|---|
| ***B25B 7/12*** | (2006.01) |
| ***B25B 7/14*** | (2006.01) |
| ***B25G 1/06*** | (2006.01) |

(52) U.S. Cl.

CPC ..... *B25B 7/12* (2013.01); *B25B 7/14* (2013.01); *B25G 1/06* (2013.01)

(58) Field of Classification Search

CPC .. B25B 7/00; B25B 7/12; B25B 7/123; B25B 7/14; B25B 7/18; B25G 1/06

(Continued)

(56) References Cited

U.S. PATENT DOCUMENTS

| | | | |
|---|---|---|---|
| 2003/0233914 | A1 | 12/2003 | Ploeger |
| 2006/0090613 | A1 | 5/2006 | Hsieh |

(Continued)

FOREIGN PATENT DOCUMENTS

| | | | |
|---|---|---|---|
| CN | 1496152 | A | 5/2004 |
| CN | 101497192 | A | 8/2009 |

(Continued)

*Primary Examiner* — David B. Thomas
*Assistant Examiner* — Aaron R McConnell
(74) *Attorney, Agent, or Firm* — Cochran Freund & Young LLC; William W. Cochran

(57) ABSTRACT

The present invention relates to an open-close handheld apparatus and a method of adjustment of the angle between the handheld portions thereof. The open-close handheld apparatus includes a first member and a second member. The first member includes a first clamping portion and a first handheld portion. The second member includes a second clamping portion and a second handheld portion. The first clamping portion and the second clamping portion are rotatably and movably connected via a first axle pin. The first clamping portion and the second clamping portion open and close relative to each other, the plane in which the open-close path thereof is located is an open-close plane. The first handheld portion is rotatably connected to the first clamping portion. The plane in which the rotation path of the first handheld portion is located is the same as or parallel to the open-close plane. A locking arrangement is provided at the joint between the first handheld portion and the first clamping portion, used for locking or unlocking the first handheld portion and the first clamping portion.

3 Claims, 11 Drawing Sheets

(58) Field of Classification Search
USPC ..... 81/177.8, 177.9, 393
See application file for complete search history.

(56) References Cited

U.S. PATENT DOCUMENTS

| | | | | |
|---|---|---|---|---|
| 2006/0230886 | A1 | 10/2006 | Hsien | |
| 2009/0199682 | A1 | 8/2009 | Hanning et al. | |
| 2017/0165852 | A1 * | 6/2017 | Feuerstein | B25G 1/04 |

FOREIGN PATENT DOCUMENTS

| | | | | |
|---|---|---|---|---|
| CN | 102554839 | B | 4/2014 | |
| DE | 29901705 | U1 | 4/1999 | |
| DE | 202009005131 | U1 | 12/2009 | |
| EP | 0027238 | A2 * | 4/1981 | B25B 13/46 |
| EP | 1944129 | A1 | 7/2008 | |
| GB | 2478631 | A | 9/2011 | |
| JP | 09504722 | A | 5/1997 | |
| JP | 003184736 | U | 7/2013 | |
| WO | 02074496 | A1 | 9/2002 | |
| WO | 2015084165 | A1 | 6/2015 | |

* cited by examiner

OPEN-CLOSE HANDHELD APPARATUS AND METHOD OF ADJUSTMENT OF ANGLE BETWEEN HANDHELD PORTIONS THEREOF

FIELD OF THE INVENTION

The present invention relates to the field of handheld tools, particularly to an open-close handheld apparatus and a method of adjustment of the angle between the handheld portions thereof.

DESCRIPTION OF THE PRIOR ART

The invention relates to a type of open-close handheld apparatus, including clamping tools and cutting tools and the like. Typical open-close handheld apparatus, such as nipper pliers, scissors and the like, are generally integrally made of handheld portions and clamping portions. In such kind of open-close apparatus, the angle between the two handheld portions is the same as the angle between the two clamping portions. According to the principle of leverage, the length of the handheld portions are set to be 3 times longer than the length of the clamping portions for saving effort.

In some specific application conditions, for example, when the item being clamped has a larger volume, the angles between the clamping portions and between the handheld portions are larger accordingly, and the distance between end parts of the two handheld portions is also larger after being opened. In this case, the user is not able to exert force with one hand to the end parts of the two handheld portions due to the limited opening area of the hand of the user, and cannot successfully complete the operation. The user is forced to be only able to exert force to the middle parts of the two handheld portions, and thus due to the smaller moment of force it is strenuous and inconvenient for the user to operate and use.

In another aspect, for the vast number of users of the open-close handheld tools, who have different size of hands and different habits of exerting forces, if the relative angle between the handheld portion and the clamping portion of the handheld tool cannot be adjusted in the open-close direction, in most cases, the users then is unable to operate and use the handheld tool in an angle which is most familiar to the users and most convenient to use.

Therefore, the person skilled in the art are devoted to developing an open-close handheld tool with the handheld portions thereof being rotatable relative to the clamping portions in the open-close direction of the clamping portions and being locked in position, so that the user can autonomously adjust the relative angle between the handheld portion and the clamping portion of the handheld tool in the open-close direction according to the size of the use's hand and the habit of exerting force, and lock the handheld tool, so that the user can operate and use the handheld tool in an angle which is most familiar to the users and most convenient to use.

SUMMARY OF THE INVENTION

In view of the above technical defects of the prior art, the object of the invention is to provide an open-close handheld apparatus in order to solve the technical problems such as the inconvenience when operating and using the open-close handheld apparatus of the prior art under special application conditions.

In order to solve the above technical problems, the invention provides an open-close handheld apparatus, including a first member and a second member, the first member includes a first clamping portion and a first handheld portion; the second member includes a second clamping portion and a second handheld portion, the first and second clamping portions are rotatably and movably connected via a first axle pin, the first and second clamping portions open and close relative to each other, the plane in which the open-close path thereof is located being an open-close plane; the first handheld portion is rotatably connected to the first clamping portion, the plane in which the rotation path of the first handheld portion is located is the same as or parallel to the open-close plane; a locking arrangement is provided at the joint between the first handheld portion and the first clamping portion, used for locking or unlocking the first handheld portion and the first clamping portion.

Further, in order to solve the above technical problems, the invention provides another open-close handheld apparatus, including a first member and a second member, the first member includes a first clamping portion and a first handheld portion; the second member includes a second clamping portion and a second handheld portion, the first and second clamping portions are rotatably and movably connected via a first axle pin, the first and second clamping portions open and close relative to each other, the plane in which the open-close path thereof is located being an open-close plane; the first handheld portion is rotatably connected to the first clamping portion, the plane in which the rotation path of the first handheld portion is located is the same as or parallel to the open-close plane; a locking arrangement is provided at the joint between the first handheld portion and the first clamping portion, used for locking or unlocking the first handheld portion and the first clamping portion. The second handheld portion is rotatably connected to the second clamping portion, the plane in which the rotation path of the second handheld portion is located is the same as or parallel to the open-close plane, a locking arrangement is provided at the joint between the second handheld portion and the second clamping portion, used for locking or unlocking the second handheld portion and the second clamping portion.

Further, in an alternative embodiment, the locking arrangement includes an extending portion provided at the bottom end of the first or second clamping portion, a protruding portion provided at the top end of the first or second handheld portion and inserted into the extending portion, a second axle pin passing through the extending portion and the protruding portion; wherein the protruding portion is movably connected to the extending portion via the second axle pin.

Further, in an alternative embodiment, the extending portion includes a first mounting plate, a second mounting plate oppositely arranged relative to the first mounting plate, an assembly groove provided between the first mounting plate and the second mounting plate, used for inserting into the protruding portion. The shape and size of the second mounting plate conform to those of the first mounting plate.

Further, in an alternative embodiment, the first mounting plate includes a first mounting hole, the second mounting plate includes a second mounting hole oppositely arranged relative to the first mounting hole, the protruding portion includes a third mounting hole, when the protruding portion is inserted into the assembly groove, the second axle pin successively passes through the first mounting hole, the third mounting hole and the second mounting hole.

Further, in an alternative embodiment, the locking arrangement further includes a first press plate provided at the top part of the second axle pin, annular sawteeth provided on the inner side walls of the first mounting hole, the third mounting hole and the second mounting hole, a spline block sheathed on the outside of the second axle pin, two or more first racks being evenly distributed on the outer side walls of the spline block, the first racks being parallel to the second axle pin, a first spring sheathed on the outside of the second axle pin, the top end of the first spring connected to the bottom part of the first press plate, the bottom end of the first spring sheathed on the top part of the spline block, and a nut threadedly connected to the lower end of the second axle pin.

Further, in an alternative embodiment, each of the first racks, from the top part to the bottom part thereof, successively includes a first notch, a first widened tooth, a second notch and a second widened tooth, when the press button is pressed downward, the first widened teeth engage with the annular sawteeth in the third mounting hole, and the locking arrangement is in the unlocked state; when the press button is released, the first widened teeth engage with the annular sawteeth in the first mounting hole and the third mounting hole, the second widened teeth engage with the annular sawteeth in the second mounting hole, and the locking arrangement is in the locked state.

Further, in an alternative embodiment, the length of the first widened tooth is less than the depth of the third mounting hole, the length of the second widened tooth is less than the maximum compression distance of the first spring; the length of the second notch is greater than the depth of the third mounting hole.

Further, in an alternative embodiment, the locking arrangement further includes a press button groove arranged at the top part of the first mounting plate and located above the first mounting hole, for placing the first press plate, a nut groove arranged at the bottom part of the second mounting plate and located below the second mounting hole, for placing the nut.

Further, in an alternative embodiment, the locking arrangement further includes angle marks provided at the top part of the first mounting plate and located around the press button groove, for marking the rotation angle of the first handheld portion relative to the first clamping portion, or for marking the rotation angle of the second handheld portion relative to the second clamping portion, positioning marks provided at the top part of the first handheld portion or the second handheld portion and being adjacent to one end of the protruding portion, the positioning marks pointing to any angle among the angle marks.

Further, in an alternative embodiment, the locking arrangement further includes a semi-circular gear formed at an end of the first mounting plate and/or the second mounting plate, a stop block protruding from the upper surface of the first handheld portion and being adjacent to the protruding portion, the stop block provided with a U-shaped groove opening facing the semi-circular gear, the bottom part of the U-shaped groove provided with a spring mounting groove, a sliding snap button arranged in the U-shaped groove, the sliding snap button includes a snap button body, the shape thereof corresponding to the shape of the bottom part of the U-shaped groove, being perpendicular to the protruding portion, a snap button dial knob, provided above the snap button body, protruding from the upper surface of the first handheld portion, a second rack protruding from a side wall of the snap button body facing a side of the semi-circular gear, the second rack being perpendicular to the protruding portion, the length thereof corresponding to that of the snap button body, a second spring mounting shaft provided on a side wall of the snap button body facing a side of the spring mounting groove, the second spring mounting shaft being parallel to the protruding portion, the second spring mounting shaft and the spring mounting groove lying in the same straight line, a second spring sheathed on the second spring mounting shaft, one of the second spring being tangent to the snap button body, the other end thereof being located in the spring mounting groove.

Further, in an alternative embodiment, when the snap button dial knob is pulled downward, the second rack is detached from the semi-circular gear of the first mounting plate and the second mounting plate, the locking arrangement being in the unlocked state; when the snap button dial knob is released, the second rack is snap engaged to the semi-circular gear of the first mounting plate and the second mounting plate, the locking arrangement being in the locked state.

Further, in an alternative embodiment, the height of the second rack protruding from the snap button body is less than the maximum compression distance of the second spring.

Further, in an alternative embodiment, the locking arrangement includes a circular gear protruding from the upper surface of the first mounting plate, the circular gear fixed to the first mounting plate or integrally arranged with the first mounting plate, two mounting bases that are oppositely arranged, protruding from the upper surface of the first handheld portion and being adjacent to the protruding portion, the two mounting bases being respectively provided with one base axle pin hole, the two base axle pin holes lying in the same straight line, a press snap button arranged between the two mounting bases, the press snap button including a second press plate, one end thereof adjacent to the protruding portion provided with a press plate axle pin hole lying in the same straight line with the two base axle pin holes, the other end thereof provided with a third spring mounting shaft protruding from and being perpendicular to the lower surface of the second press plate, a snap engaging portion provided at one end of the second press plate adjacent to the protruding portion, the snap engaging portion and the second press plate forming an angle of 120-160 degrees therebetween, and a third rack provided at the top part of the snap engaging portion, the third rack protruding downward and directly facing the circular gear, a third axle pin passing through the press plate axle pin hole and two base axle pin holes simultaneously, and a third spring sheathed on the outside of the third spring mounting shaft, one end of the third spring being tangent to the lower surface of the press snap button body, the other end thereof being tangent to the upper surface of the first handheld portion.

Further, in an alternative embodiment, when the second press plate is pressed downward, the third rack is detached from the circular gear, the locking arrangement being in the unlocked state; when the second press plate is released, the third rack is snap engaged to the circular gear, the locking arrangement being in the locked state.

Further, in an alternative embodiment, the locking arrangement includes a first sliding axle pin provided at the joint between the upper part of the first handheld portion and the bottom end of the first clamping portion, a first fixation axle pin provided at the joint between the top end of the first handheld portion and the top end of the second handheld portion, a second fixation axle pin provided at the joint between the upper part of the second handheld portion and the bottom end of the second clamping portion, wherein the first sliding axle pin is slidably mounted to the first clamping portion.

Further, in an alternative embodiment, the locking arrangement includes a first sliding axle pin provided at the joint between the upper part of the first handheld portion and the bottom end of the first clamping portion, a first fixation axle pin provided at the joint between the top end of the first handheld portion and the top end of the second handheld portion, a second sliding axle pin provided at the joint between the upper part of the second handheld portion and the bottom end of the second clamping portion, wherein the first sliding axle pin is slidably mounted to the first clamping portion, the second sliding axle pin is slidably mounted to the second clamping portion.

Further, in an alternative embodiment, the locking arrangement further includes two or more location holes communicated with each other, provided at the bottom end of the first clamping portion and/or the second clamping portion, the first sliding axle pin and/or the second sliding axle pin slidably mounted into the location holes, at least one sliding opening, each provided at the communication location between two adjacent location holes.

Further, in an alternative embodiment, the first sliding axle pin or the second sliding axle pin successively includes a third press plate, a thin shaft portion, a thick shaft portion and an axle pin base that are connected with each other, the third press plate and the axle pin base protrude from the outside of the first handheld portion or the second handheld portion, the diameter of the thin shaft portion corresponds to the width of the sliding opening, the diameter of the thick shaft portion corresponds to the diameter of the location hole.

Further, in an alternative embodiment, the locking arrangement further includes one or two interlocking plate, one end thereof connected to the first fixation axle pin, the other end connected to the axle pin base of the first sliding axle pin and/or the second sliding axle pin.

Further, in an alternative embodiment, when the third press plate is pressed downward, the thick shaft portion is detached from one location hole, the locking arrangement being in the unlocked state, the thin shaft portion passing through one sliding opening and sliding to a next location hole, when the third press plate is released, the thick shaft portion enters into a next location hole, the locking arrangement being in the locked state.

Further, in an alternative embodiment, the apparatus further includes an elastic support member, the cross-section thereof being an inverted V-shape, including a first support arm, one end thereof passing through and fixed to the first handheld portion and the first clamping portion, a second support arm, one end thereof passing through and fixed to the second handheld portion and the second clamping portion, the other end thereof connected to the first support arm, an arc corner located at the joint between the first support arm and the second support arm, the inner side surface of the arc corner being tangent to the outer surface of the first fixation axle pin.

Further, in an alternative embodiment, the first handheld portion or the second handheld portion includes a handle, or includes a handle and a protective sleeve, the protective sleeve being sheathed on the outside of the handle.

Further, in an alternative embodiment, the open-close handheld apparatus includes but not limited to clamping means and cutting means, the clamping means including but not limited to pliers, the cutting means including but not limited to scissors.

Another object of the invention is to provide a method of adjustment of the angle between the handheld portions of the open-close handheld apparatus to solve the technical problems such as the inconvenience when operating and using the open-close handheld apparatus of the prior art under special application conditions.

In order to solve the above technical problems, the invention provides a method of adjustment of the angle between the handheld portions of the open-close handheld apparatus including the following steps: unlocking the first handheld portion, turning the first handheld portion relative to the first clamping portion, locking the first handheld portion, wherein the plane in which the rotation path of the first handheld portion is located is the same as or parallel to the open-close plane.

In order to solve the above technical problems, the invention provides a method of adjustment of the angle between the handheld portions of the open-close handheld apparatus including the following steps: unlocking the first handheld portion, turning the first handheld portion relative to the first clamping portion, locking the first handheld portion, unlocking the second handheld portion, turning the second handheld portion relative to the second clamping portion, locking the second handheld portion, wherein the plane in which the rotation path of the first handheld portion is located is the same as or parallel to the open-close plane, the plane in which the rotation path of the second handheld portion is located is the same as or parallel to the open-close plane.

The advantage of the invention lies in that an open-close handheld apparatus and a method of adjustment of the angle between the handheld portions thereof are provided, and the user can autonomously adjust the relative angle between the handheld portion and the clamping portion of the handheld tool in the open-close direction according to the size of the use's hand and the habit of exerting force, and lock the handheld tool, so that the user can operate and use the handheld tool in an angle which is most familiar to the users and most convenient to use.

Under some special application conditions, for example, when the volume of the object to be clamped is large, the angle between the clamping portions therefore is large, yet the angle between the handheld portions can then be adjusted to a proper position so that the distance between the two ends of the two opened handheld portions can be relatively small, and the user can exert force with a single hand to the ends of the two handheld portions so as to complete the operation smoothly, which is more effort saving compared with normal open-close apparatus.

The concepts, the specific structures and the technical effects of the present invention are described further below in conjunction with the accompanying drawings, in order to fully understand the objects, features and effects of the present invention.

REFERENCE NUMERALS LISTED AS FOLLOWS

Figure 1:
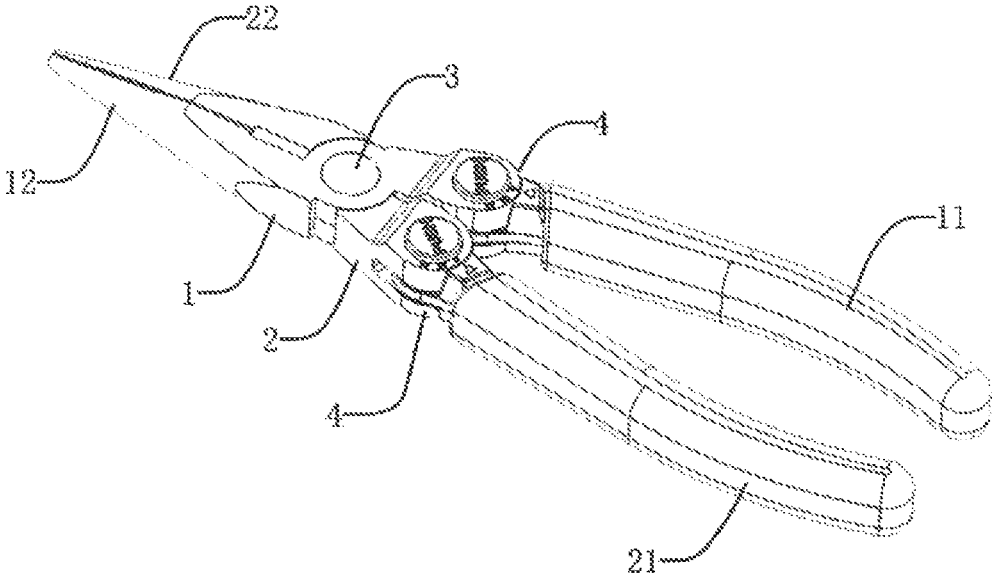
FIG. 1 is an overall structural schematic view of an open-close handheld apparatus in Example 1 of the invention.

| | |
|---|---|
| 1 | first member, |
| 2 | second member, |
| 3 | first axle pin, |
| 4 | locking arrangement; |
| 11 | first handheld portion, |
| 12 | first clamping portion, |
| 21 | second handheld portion, |
| 22 | second clamping portion; |

-continued

| | |
|---|---|
| 31 | extending portion, |
| 32 | protruding portion, |
| 33 | second axle pin; |

101 first press plate, 102 annular sawteeth, 103 spline block, 104 first spring, 105 nut, 106 press button groove, 107 nut groove, 108 angle mark, 109 positioning mark, 110 handle, 111 protective sleeve;

201 semi-circular gear, 202 stop block, 203 sliding snap button, 204 second spring, 205 U-shaped groove, 206 spring mounting groove;

301 circular gear, 302 mounting base, 303 press snap button, 304 third axle pin; 305 third spring;

311 first mounting plate, 312 second mounting plate, 313 assembly groove, 314 first mounting hole, 315 second mounting hole, 321 third mounting hole;

401 elastic support member, 402 first sliding axle pin, 403 first fixation axle pin, 404 second fixation axle pin, 405 location hole, 406 sliding opening, 407 interlocking plate, 408 fixation ring;

1031 first rack, 1032 first notch, 1033 first widened tooth, 1034 second notch, 1035 second widened tooth;

2031 snap button body, 2032 snap button dial knob, 2033 second rack, 2034 second spring mounting shaft;

3021 base axle pin hole, 3031 second press plate, 3032 snap engaging portion, 3033 third rack, 3034 press plate axle pin hole, 3035 third spring mounting shaft;

4011 first support arm, 4012 second support arm, 4013 arc corner;

4021 third press plate, 4022 thin shaft portion, 4023 thick shaft portion, 4024 axle pin base.

DETAILED DESCRIPTION OF THE PREFERRED EMBODIMENTS

The present invention will be described more fully hereinafter with reference to the accompanying drawings, in which preferred embodiments of the invention are shown, for the purpose of clarity and better understanding of the techniques. This invention may be embodied in various different forms and the invention should not be construed as being limited to the embodiments set forth herein.

In the accompanying drawings, elements with identical structure are marked with the same reference numerals, and like elements with similar structure or function are marked throughout with like reference numerals, respectively. The dimension and thickness of each of the elements in the accompanying drawings are arbitrarily shown, and the present invention does not define the dimension and thickness of each of the elements. Certain elements may be shown somewhat exaggerated in thickness in the interest of clarity.

Directional terms described by the present invention, such as upper, lower, front, back, left, right, inner, outer, side, top, bottom, upper end, lower end, terminal end and etc., are only directions by referring to the accompanying drawings, and are thus used to explain and describe the present invention, but the present invention is not limited thereto.

It will be understood that when an element is referred to as being "on" another element, it can be directly on the other element, or there may be an intermediate element on which the element is placed, and the intermediate element is placed on the other element. When an element is referred to as being "mounted to" or "connected to" another element, either one can be understood as being directly "mounted" or "connected", or via an intermediate element to be indirectly "mounted to" or "connected to" the other element.

Embodiment 1

Figure 2:
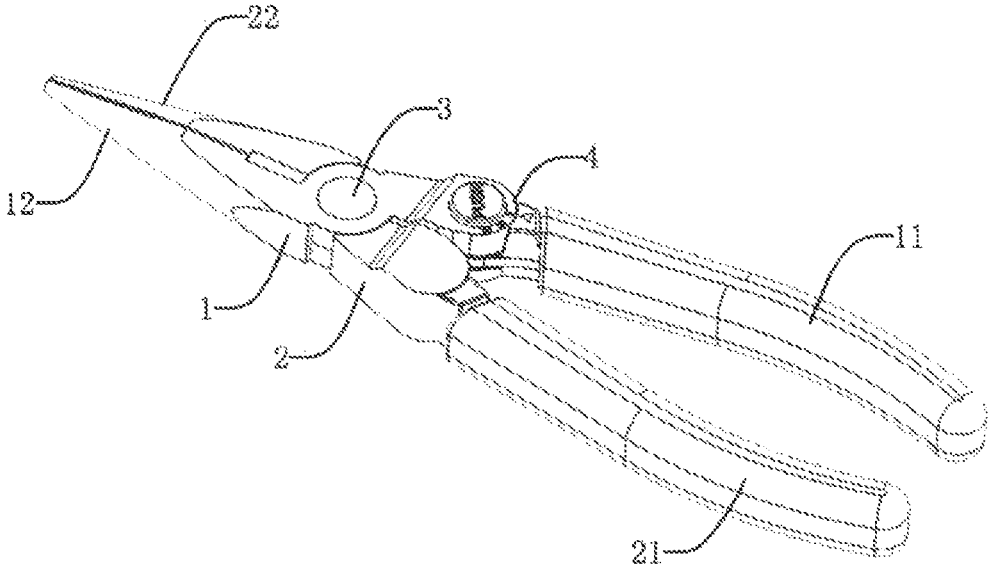
FIG. 2 is an overall structural schematic view of another open-close handheld apparatus in Example 1 of the invention.

As shown in FIGS. 1-2, Embodiment 1 provides an open-close handheld apparatus, which includes a first member 1 and a second member 2.

The first member 1 includes a first handheld portion 11 and a first clamping portion 12. The first handheld portion 11 is located at the bottom part of the first member 1. The first clamping portion 12 is located at the top art of the first member 1. The second member 2 includes a second handheld portion 21 and a second clamping portion 22. The second handheld portion 21 is located at the bottom part of the second member 2. The second clamping portion 22 is located at the top part of the second member 2. The first clamping portion 12 and the second clamping portion 22 are rotatably and movably connected via a first axle pin 3. The first clamping portion 12 and the second clamping portion 22 open and close relative to each other, and the plane in which the open-close path thereof is located is an open-close plane. The top end and/or the bottom end of the second clamping portion 22 are oppositely arranged relative to that of the first clamping portion 12. The second handheld portion 21 is oppositely arranged relative to the first handheld portion 11.

One technical feature of the embodiment lies in that, as shown in FIG. 2, the first handheld portion 11 is rotatably connected to the first clamping portion 12. The plane in which the rotation path of the first handheld portion 11 is the same as or parallel to the open-close plane. A locking arrangement 4 is provided at the joint between the first handheld portion 11 and the first clamping portion 12, used for locking or unlocking the first handheld portion and the first clamping portion 12.

Another technical feature of the embodiment lies in that, the second handheld portion 21 is rotatably connected to the second clamping portion 22. The plane in which the rotation path of the second handheld portion 21 is the same as or parallel to the open-close plane. A locking arrangement 4 is provided at the joint between the second handheld portion 21 and the second clamping portion 22, used for locking or unlocking the second handheld portion 21 and the second clamping portion 22.

As shown in FIG. 1, the embodiment can have both of the above technical features simultaneously, or can only have one of the two above technical features.

In use, the locking arrangement 4 of the embodiment is originally in the locked state and can be used normally. When the angle of the first handheld portion 11 or the second handheld portion 21 needs to be adjusted, the locking arrangement 4 is first required to be unlocked, and then the first handheld portion 11 or the second handheld portion 21 is rotated to a desired angle relative to the first clamping portion 12 or the second clamping portion 22, and the locking arrangement 4 is then locked so that the first handheld portion 11 is held fixed relative to the first clamping portion 12, or the second handheld portion 21 is held fixed relative to the second clamping portion 22 for continuous use. The angle between the handheld portion and the clamping portion can be adjusted prior to the normal use of this embodiment, however, during use where the two clamping portions are opened to clamp the object to be clamped, the handheld portion and the clamping portion are held in the locked state and the two are fixed relative to each other.

Figure 3:
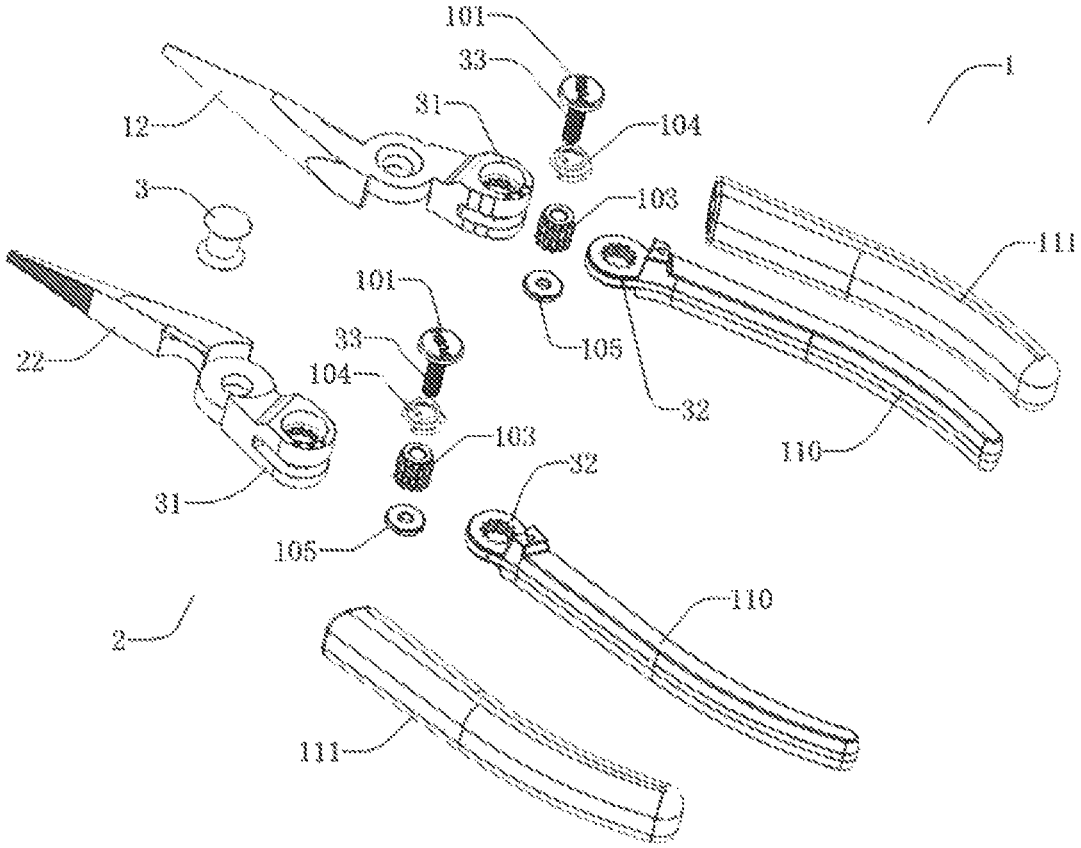
FIG. 3 is an exploded structural schematic view of an open-close handheld apparatus in Example 1 of the invention.
Figure 4:
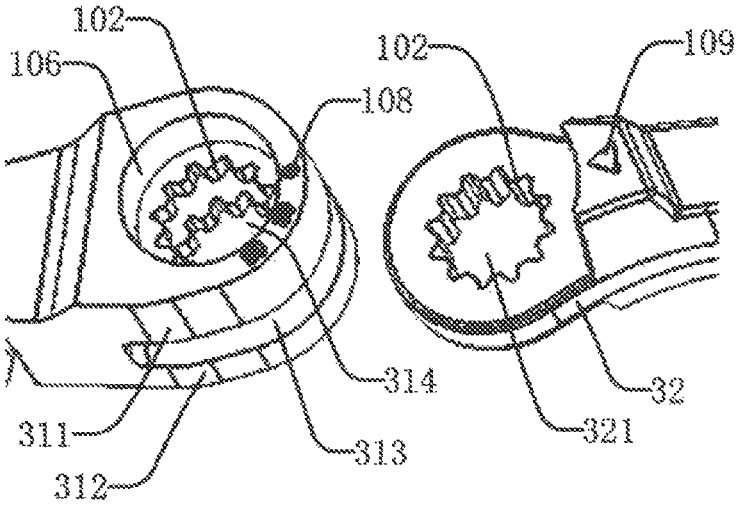
FIG. 4 is a structural schematic view of the extending portion and the upper part of the protruding portion in Example 1 of the invention.
Figure 5:
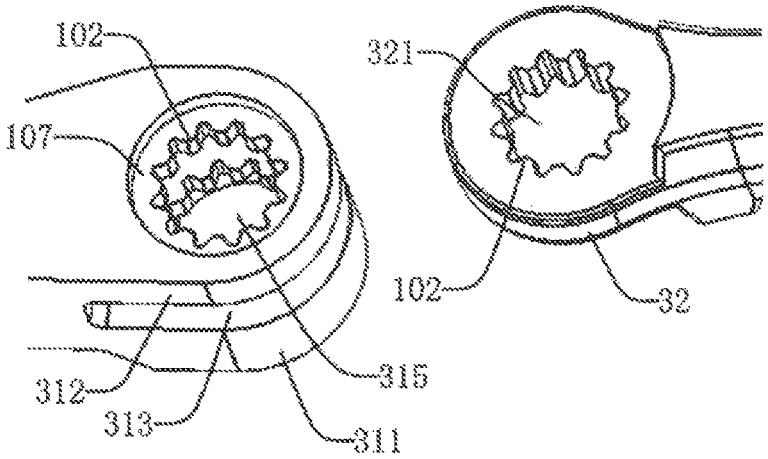
FIG. 5 is a structural schematic view of the extending portion and the lower part of the protruding portion in Example 1 of the invention.

As shown in FIGS. 3-5, the locking arrangement 4 includes an extending portion 31, a protruding portion 32 and a second axle pin 33.

The extending portion 31 is provided at the bottom end of the first clamping portion 12, the cross-section of which is approximately U-shaped, and the extending portion 31 includes a first mounting plate 311, a second mounting plate 312, an assembly groove 313. The second mounting plate 312 is oppositely arranged relative to the first mounting plate 311, and the assembly groove 313 is arranged between the first mounting plate 311 and the second mounting plate 312. The assembly groove 313 is used for insertion of the protruding portion 32. The second mounting plate 312 has shape and size corresponding to those of the first mounting plate 311.

The protruding portion 32 is provided at the top end of the first handheld portion, and is inserted into the extending portion 31, specifically, inserted into the assembly groove 313. The second axle pin 33 is passed through the extending portion 31 and the protruding portion 32 simultaneously. The protruding portion 32 is movably connected to the extending portion 31 via the second axle pin 33, so that the first handheld portion 11 is rotatable relative to the first clamping portion 12.

The first mounting plate 311 includes a first mounting hole 314, and the second mounting plate 312 includes a second mounting hole 315. The second mounting hole 315 is oppositely arranged relative to the first mounting hole 314, and has shape and size corresponding to those of the first mounting hole 314. The protruding portion 32 includes a third mounting hole 321, which has shape and size corresponding to those of the first mounting hole 314 and the second mounting hole 315. When the protruding portion 32 is inserted into the assembly groove 313, the second axle pin 33 is successively passed through the first mounting hole 314, the third mounting hole 321 and the second mounting hole 315.

In the present invention, the extending portion 31 and the protruding portion 32 of the locking arrangement 4 are rotated relative to each other via the second axle pin 33, so as to drive the relative rotation of the handheld portion and the clamping portion.

Figure 6:
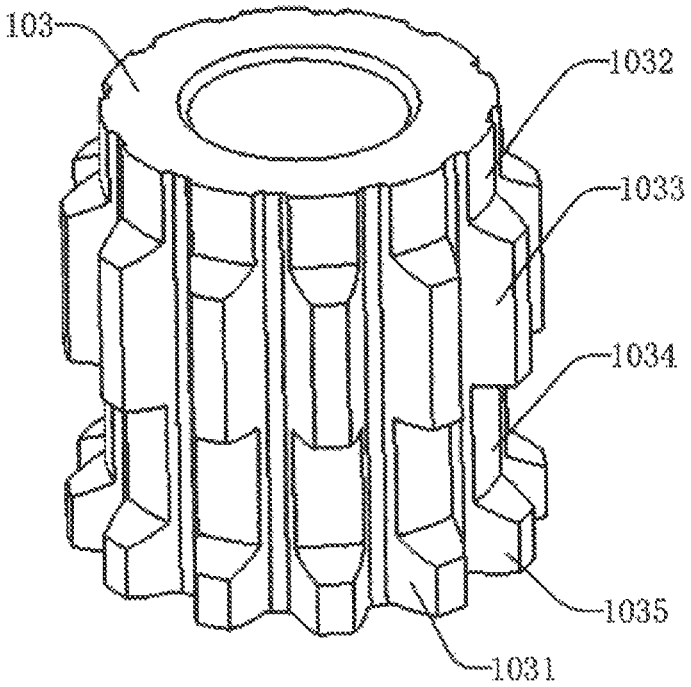
FIG. 6 is an overall structural schematic view of a spline block in Example 1 of the invention.
Figure 7:
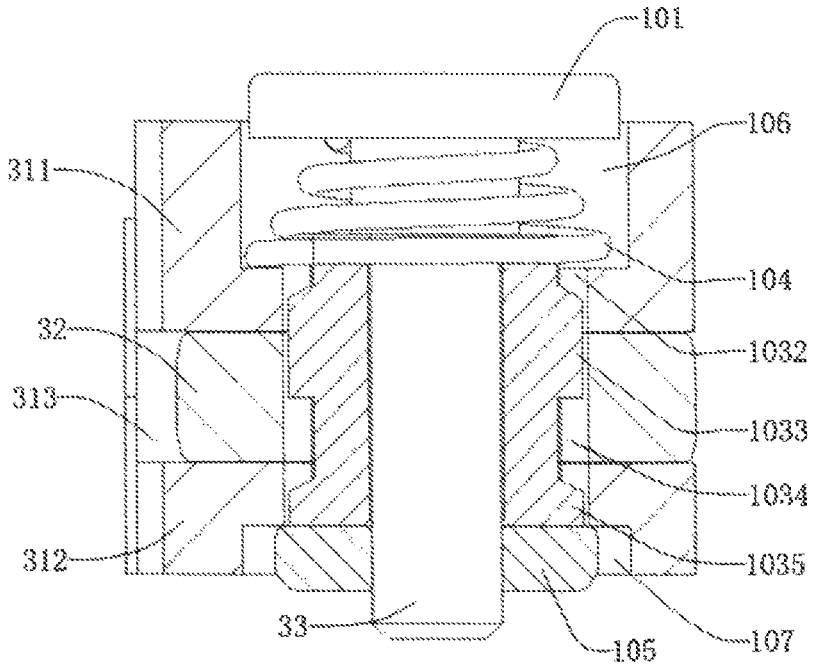
FIG. 7 is a sectional structural schematic view of a locking arrangement in the locked state in Example 1 of the invention.
Figure 8:
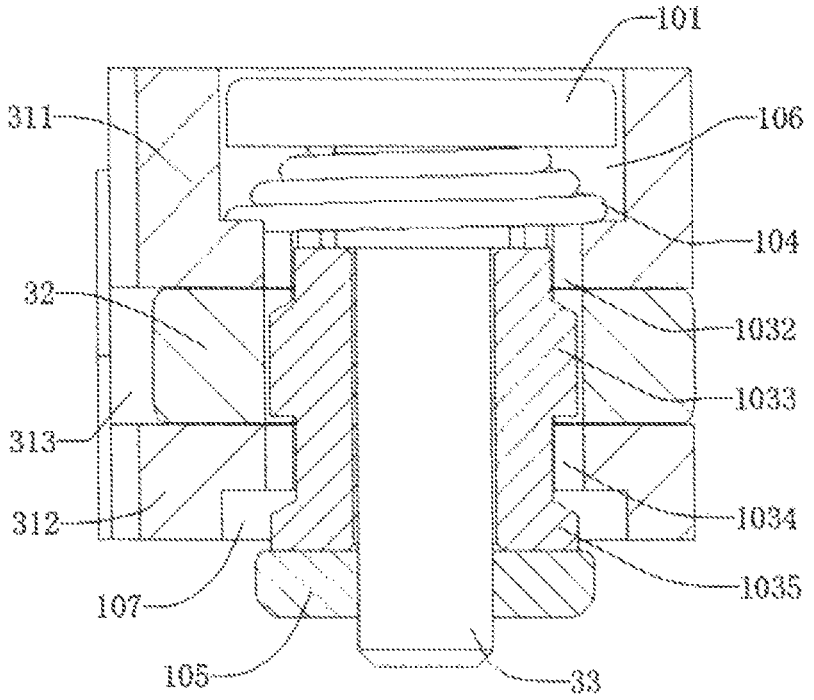
FIG. 8 is a sectional structural schematic view of a locking arrangement in the unlocked state in Example 1 of the invention.
Figure 9:
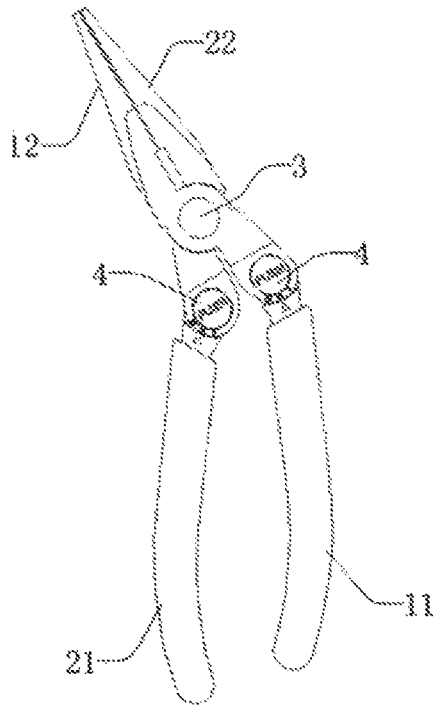
FIG. 9 is a schematic view of the shape of the open-close handheld apparatus in Example 1 of the invention, with the angle between the handheld portions having been adjusted.

As shown in FIGS. 6-8, the locking arrangement 4 further includes a first press plate 101, annular sawteeth 102, a spline block 103, a first spring 104 and a nut 105.

The first press plate 101 is arranged at the top part of the second axle pin 33, the second axle pin 33 is perpendicular to the first press plate 1011, and the outer side wall of the lower end of the second axle pin 33 is provided with external thread for mounting of the nut 105.

As shown in FIG. 4 and FIG. 5, the annular sawteeth 102 are respectively arranged on the inner side walls of the first mounting hole 314, the third mounting hole 321 and the second mounting hole 315.

As shown in FIGS. 6-8, the spline block 103 has a cylindrical body with a cylindrical cavity provided therein, sheathed on the outside of the sliding bar 1012. Two or more first racks 1031 are evenly distributed around the outer side wall of the spline block 103, and the first racks 1031 are parallel to the sliding bar 1012. The cylindrical body of the spline block 103 together with multiple first racks 1031 forms a gear arrangement engaging with the annular sawteeth 102. Each of the first racks 1031 from the top part to the bottom part thereof includes successively: a first notch 1032, a first widened tooth 1033, a second notch 1034 and a second widened tooth 1035. The length of the first widened tooth 1033 is less than the depth of the third mounting hole 321. The length of the second widened tooth 1035 is less than the maximum compression distance of the first spring 104. The length of the second notch 1034 is greater than the depth of the third mounting hole 321. The setting of the lengths of these components can ensure that the first handheld portion 11 is held fixed relative to the first clamping portion 12 (the locking arrangement being in the locked state) when the spline block 103 is in the original position; and the first handheld portion 11 is separated relative to the first clamping portion 12 (the locking arrangement 4 being in the unlocked state) when the spline block 103 is sliding downward, so that the first handheld portion 11 is rotatable relative to the first clamping portion 12.

The first spring 104 is sheathed on the outside of the second axle pin 33, and the top end of the first spring 104 is connected to the bottom part of the first press plate 101, and the bottom end thereof is sheathed on the top part of the spline block 103. When the first press plate 101 is pressed downward, the spline block 103 slides downward. When the first press plate 101 is released, the spline block 103 can be reset by sliding upward to its original position under the action of the first spring 104.

The nut 105 is sheathed on the lower end of the second axle pin 33. The inner side wall of the nut 105 is provided with internal thread. The nut 105 corresponds to the external thread of the second axle pin 33. The nut 105 is in threaded connection with the lower end of the second axle pin 33, so that the first press plate 101, the spline block 103 and the first spring 104 are combined to be an integral part without separation from each other.

As shown in FIG. 7, in normal state, the first spring 104 is in the relaxed state. The plurality of first widened teeth 1033 of the spline block 103 are engaged with the annular sawteeth 102 inside the first mounting hole 314 and the third mounting hole 321. The plurality of the second widened teeth 1035 are engaged with the annular sawteeth 102 inside the second mounting hole 321. The extending portion 31 and the protruding portion 32 are relatively fixed, the locking arrangement 4 is kept in the locked state, and the first handheld portion 11 is held fixed relative to the first clamping portion 12.

As shown in FIG. 8, when the press button 101 is pressed downward, the first spring 104 is in the pressed state. The first widened teeth 1033 are only engaged with the sawteeth inside the third mounting hole 321, and are detached from the sawteeth inside the first mounting hole 314 and the second mounting hole 315. The locking arrangement 4 is unlocked to be in the unlocked state. The extending portion 31 is rotatable relative to the protruding portion 32 with the second axle pin as the axis of rotation. The first handheld portion 11 is rotatable relative to the first clamping portion 12.

After completion of rotation, the first spring 104 is in the relaxed state when the first press plate 101 is released as shown in FIG. 7. The first widened teeth 1033 are engaged with the sawteeth inside the first mounting hole 314 and the third mounting hole 321. The second widened teeth 1035 are engaged with the sawteeth inside the second mounting hole 321. The extending portion 31 is fixed relative to the protruding portion 32, the locking arrangement 4 is in the locked state, and the first handheld portion 11 is held fixed relative to the first clamping portion 12.

As shown in FIG. 4 and FIG. 5, the locking arrangement 4 further includes a press button groove 106 and a nut groove 107. The press button groove 106 is arranged on the top part of the first mounting plate 311, and is located above the first mounting hole 314, for placing the first press plate 1011. The nut groove 107 is arranged on the bottom part of the second mounting plate 312, and is located below the second mounting hole 315, for placing the nut 105.

As shown in FIG. 4, in Embodiment 1, the locking arrangement 4 further includes angle marks 108 and a positioning mark 109. The angle marks 108 are provided on the top part of the first mounting plate 311, and are located around the press button groove 106. The angle mark 109 is used for marking the rotation angle of the first handheld portion 11 relative to the first clamping portion 12. The positioning mark 109 is provided on the top part of the first handheld portion 11, and is adjacent to an end of the protruding portion 32. The positioning mark 109 points to any angle value among the angle marks 108. The angle marks 108 and the positioning mark 109 are cooperatively used so as to help the user to know in real time and timely adjust the deflection angle of the handheld portion.

The open-close handheld apparatus according to the present invention includes, but not limited to, clamping means and cutting means. The clamping means includes, but not limited to, pliers. The cutting means includes, but not limited to, scissors.

As shown in FIG. 1 and FIG. 2, Embodiment 1 provides an open-close handheld apparatus, specifically, a pair of nipper pliers. The first clamping portion 12 and the second clamping portion 22 are the clamp head. The first handheld portion 11 and the second handheld portion 21 include a handle 110, and may further include a protective sleeve 111 sheathed on the outside of the handle 110. One handle is fixedly connected with the clamp head, and the joint between the other handle and the clamp head is rotatable, the rotational direction being consistent with the open-close direction of the clamp head. The plane in which the rotation path of the handle 110 is located is the same as or parallel to the open-close plane of the clamp head.

Figure 10:
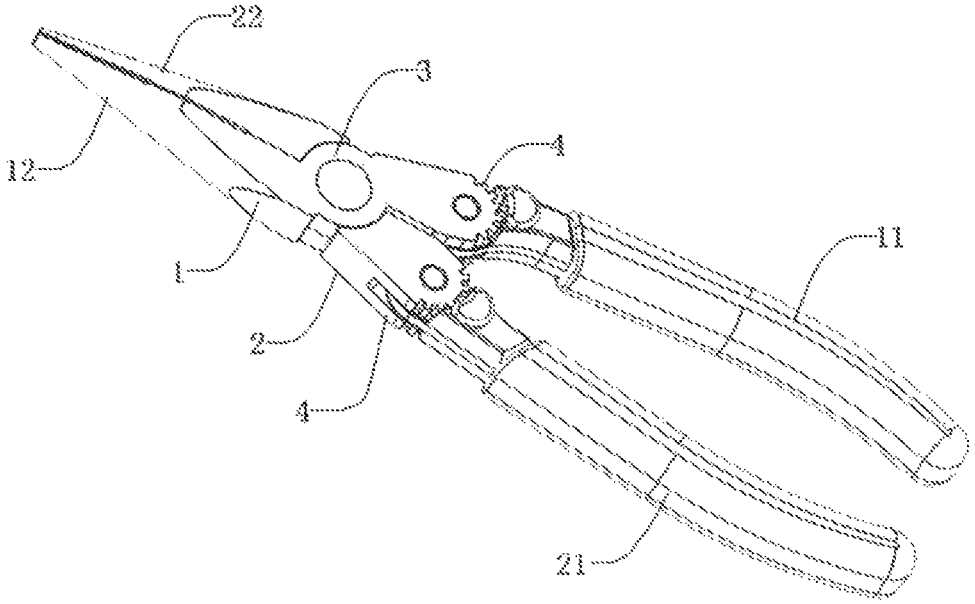
FIG. 10 is an overall structural schematic view of an open-close handheld apparatus in Example 2 of the invention.
Figure 11:
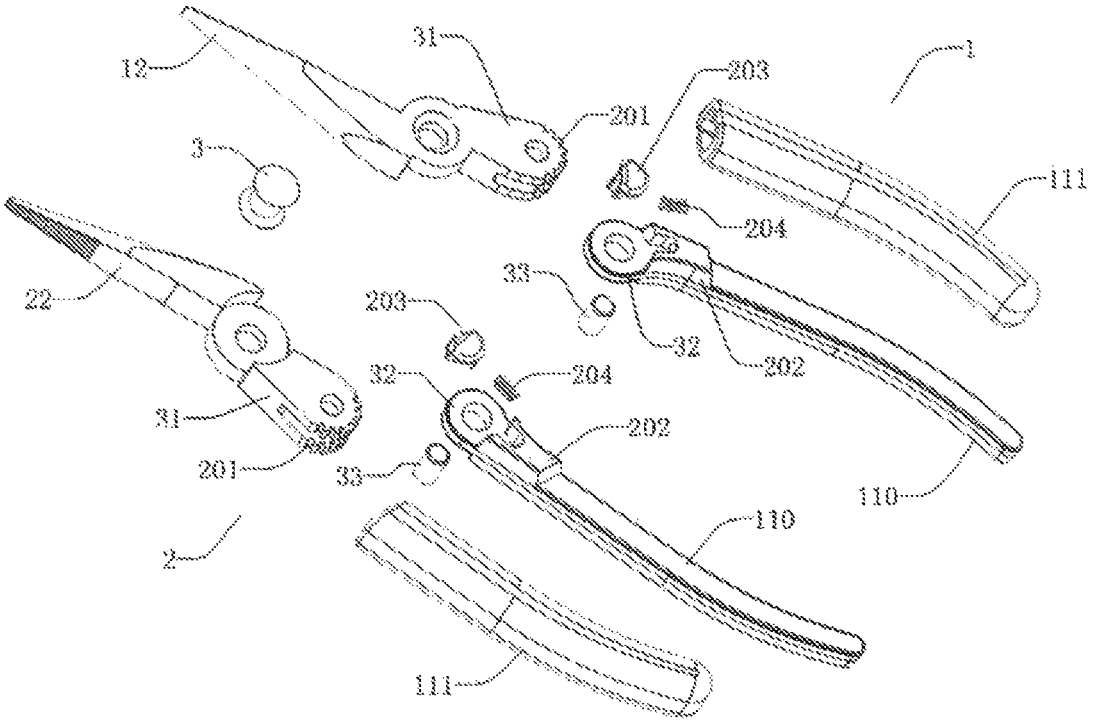
FIG. 11 is an exploded structural schematic view of an open-close handheld apparatus in Example 2 of the invention.
Figure 12:
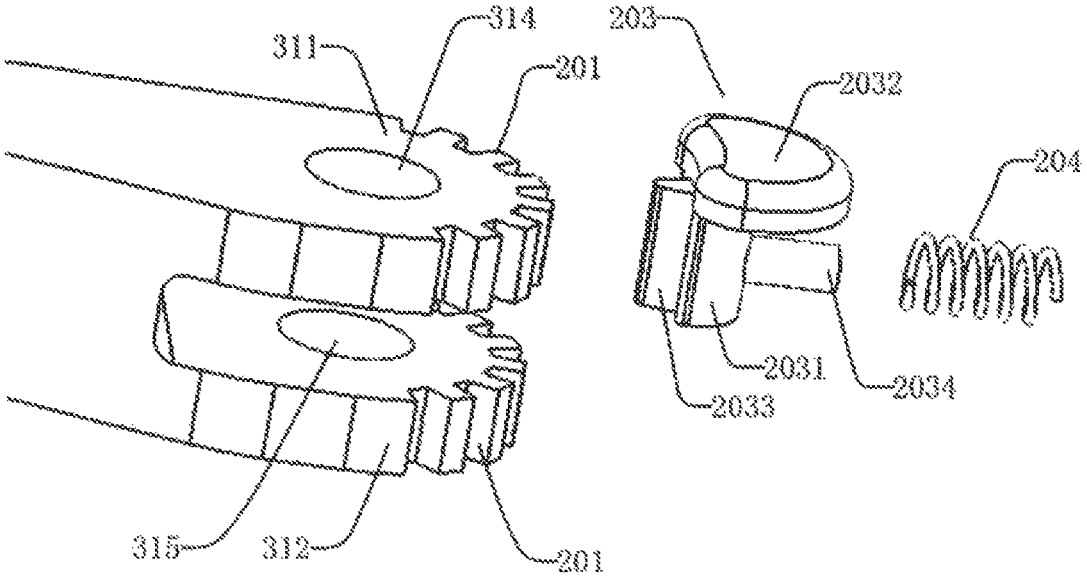
FIG. 12 is an exploded structural schematic view of the locking arrangement in Example 2 of the invention.

The technical effect of Embodiment 1 lies in that Embodiment 1 includes two handheld portions, one or two of which is rotatable relative to the clamping portions. Under some special conditions, for example, in the case when the space is limited or the clamping portions are excessively wide open, the user can adjust the angle of one or two handheld portion, so as to adjust the distance and the operation angle between the two handheld portions for facilitating the operation and the use. As shown in FIG. 10, relatively, the scheme where both of the angles of the two handheld portion are adjustable has a larger range of adjustable angle and a larger adjustable distance between the two handheld portions and thus wider range of application compared with the scheme where the angle of a single handheld portion is adjustable.

Embodiment 2

As shown in FIGS. 10-14, Embodiment 2 provides another open-close handheld apparatus, specifically, a pair of nipper pliers, which includes most technical schemes as in Embodiment 1, where the locking arrangement 4 includes an extending portion 31, a protruding portion 32 and a second axle pin 33, and the structural function and principle are the same as the embodiment, which will not be described here. In addition, the open-close handheld apparatus in Embodiment 2, compared with Embodiment 1, has the following distinguishing technical features: the locking arrangement 4 further including a semi-circular gear 201, a stop block 202, a sliding snap button 203 and a second spring 204.

Figure 13:
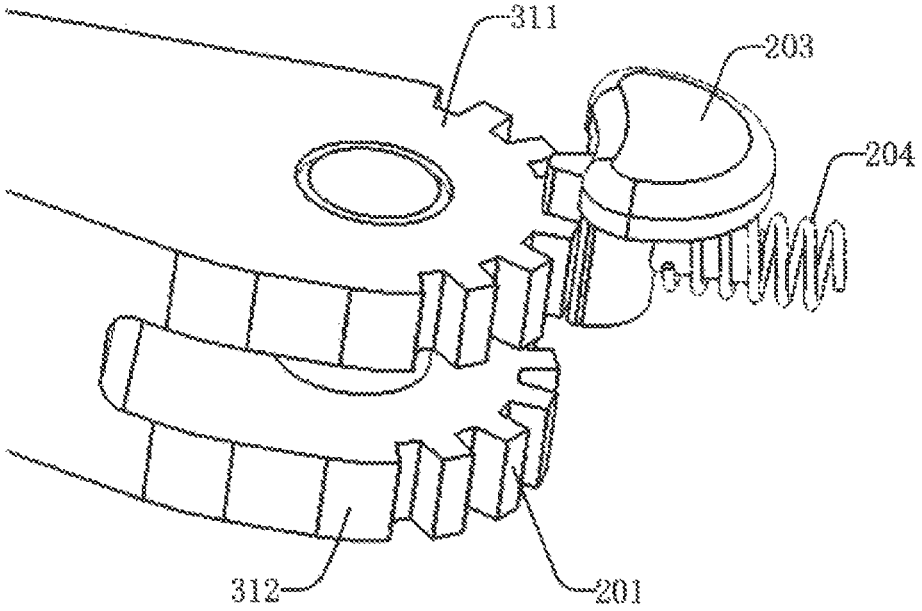
FIG. 13 is a structural schematic view of the locking arrangement in the locked state in Example 2 of the invention.
Figure 14:
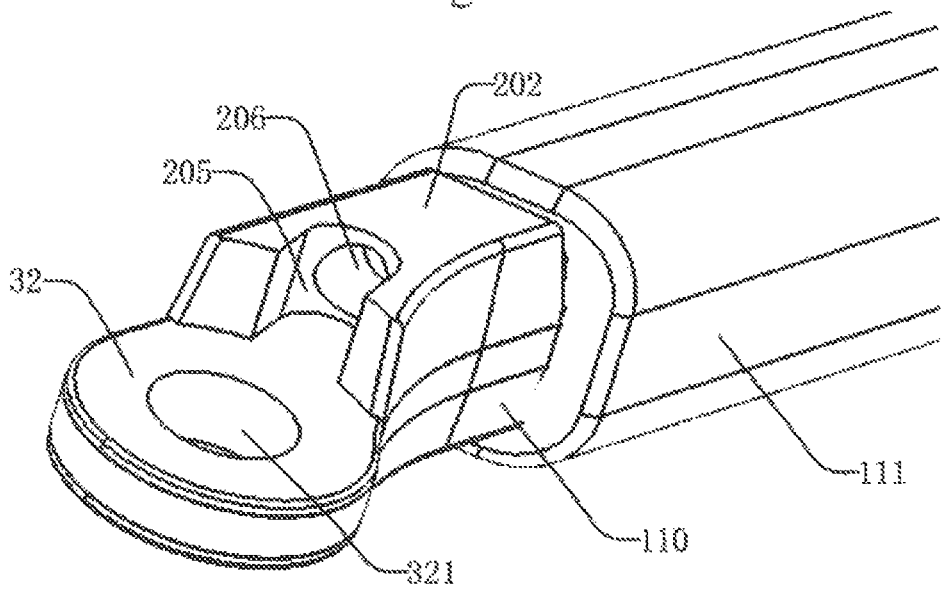
FIG. 14 is a structural schematic view of a stop block in Example 2 of the invention.

As shown in FIG. 13 and FIG. 14, the semi-circular gear 201 is formed at the terminal end of the first mounting plate 311 and/or the second mounting plate 312. Generally, as long as one mounting plate has a semi-circular gear 201 arranged at its terminal end, the sliding snap button 203 can be snap fitted to the semi-circular gear 201 to function as a position lock. If the other mounting plate is further arranged with a semi-circular gear 201, it cannot be directly engaged with the sliding snap button 203 to function as a lock, yet it can facilitate the assembly and replacement of the components.

If the two handheld portions are both rotatably connected to the clamping portions, then the two handheld portions and the two clamping portions are not integrally designed, instead they are assembled with each other. If only one mounting plate is arranged with a semi-circular gear 201 at its terminal end, then the two handheld portions can only be fixedly mounted to a specific clamping portion, the left and right handheld portions having different shapes and the two being not interchangeable. In order to facilitate maintenance and replacement of the components as well as production and assembly, a semi-circular gear 201 can be arranged at the terminal ends of the first mounting plate 311 and the second mounting plate 312 respectively.

The stop block 202 protrudes from the upper surface of the handheld portion 11 or the second handheld portion 21, and is adjacent to the protruding portion 32, specifically, the stop block 202 protrudes from the upper surface of the handle. The stop block 202 is provided with a U-shaped groove 205 opening toward the semi-circular gear 201, and the bottom part of the U-shaped groove 205 is provided with a spring mounting groove 206 for mounting the second spring 2034.

The sliding snap button 203 is arranged inside the U-shaped groove 205, and includes a snap button body 2031, a snap button dial knob 2032, a second rack 2033, a second spring mounting shaft 2034. The shape of the snap button body 2031 corresponds to the shape of the bottom part of the U-shaped groove 205, and is perpendicular to the protruding portion 32. The snap button dial knob 2033 is provided above the snap button body 2031 and protrudes from the upper surface of the first handheld portion 11. The second rack 2033 protrudes from the side wall of the snap button body 2031 and facing the side of the semi-circular gear 201. The second rack 2033 is perpendicular to the protruding portion 32, and the length thereof corresponds to the snap button body 2031, which can be used to snap fitted to the semi-circular gear 201. The height by which the second rack 2033 protrudes from the snap button body 2031 is less than the maximum compression distance of the second spring 2034. When the snap button dial knob 2032 is pulled downward, the second spring 2034 is compressed, and the second rack 2033 can completely retract into the U-shaped groove 205, so that the extending portion 31 and the protruding portion 32 can rotate so as to drive the handheld portion to rotate relative to the supporting portion. The second spring mounting shaft 2034 is provided on the side wall of the snap button body 2031, facing the side of the spring mounting groove 206. The second spring mounting shaft 2034 is parallel to the protruding portion 32 and is on the same straight line as the spring mounting groove 206, which can be used for mounting the second spring 204.

The second spring 204 is sheathed on the second spring mounting shaft 2034. One end of the second spring is tangent to the snap button body 2031, and the other end is located inside the spring mounting groove 206. The sliding snap button 203 can slide back and forth inside the U-shaped groove 205, and the second spring 204 can help resetting the sliding snap button 203.

In the operation of this embodiment, in the normal state, the second spring 204 is in a relaxed state. The second rack 2033 is snapped into the the semi-circular gear 201, the locking arrangement 4 is held in the locked state, and the handheld portion 11/21 can be held fixed relative to the clamping portion 12/22.

When the snap button dial knob 2032 is pulled downward, the second spring 204 is in the compressed state. The second rack 2033 retracts back to the U-shaped groove 205 and detaches from the semi-circular gear 201, the locking arrangement 4 is unlocked to be adjusted to the unlocked state, and the handheld portion 11/21 can rotate relative to the clamping portion 12/22, that is, the first handheld portion 11 rotates relative to the first clamping portion 12, or the second handheld portion 21 rotates relative to the second clamping portion 22.

After the completion of rotation, the snap button dial knob 2032 is released, the second spring 204 is again in the relaxed state. The second rack 2033 is snap fitted to the semi-circular gear 201 of the first mounting plate 311 and the second mounting plate 312, the locking arrangement 4 is reset to and held in the locked state, and the handheld portion 11/21 can be held fixed relative to the clamping portion 12/22.

The technical effect of Embodiment 2 lies in that, Embodiment 2 includes two handheld portions, one or two of which is rotatable relative to the clamping portion. Under some special conditions, for example, in the case when the space is limited or the clamping portions are excessively wide open, the user can adjust the angle of one or two handheld portion, so as to adjust the distance and the operation angle between the two handheld portions for facilitating the operation and the use. Relatively, the scheme where both of the angles of the two handheld portions are adjustable has a larger range of adjustable angle and a larger adjustable distance between the two handheld portions compared with the scheme where the angle of a single handheld portion is adjustable. The components in Embodiment 2 have simpler structure, lower processing cost, and are convenient to use with wider range of application compared with Embodiment 1.

Embodiment 3

Figure 15:
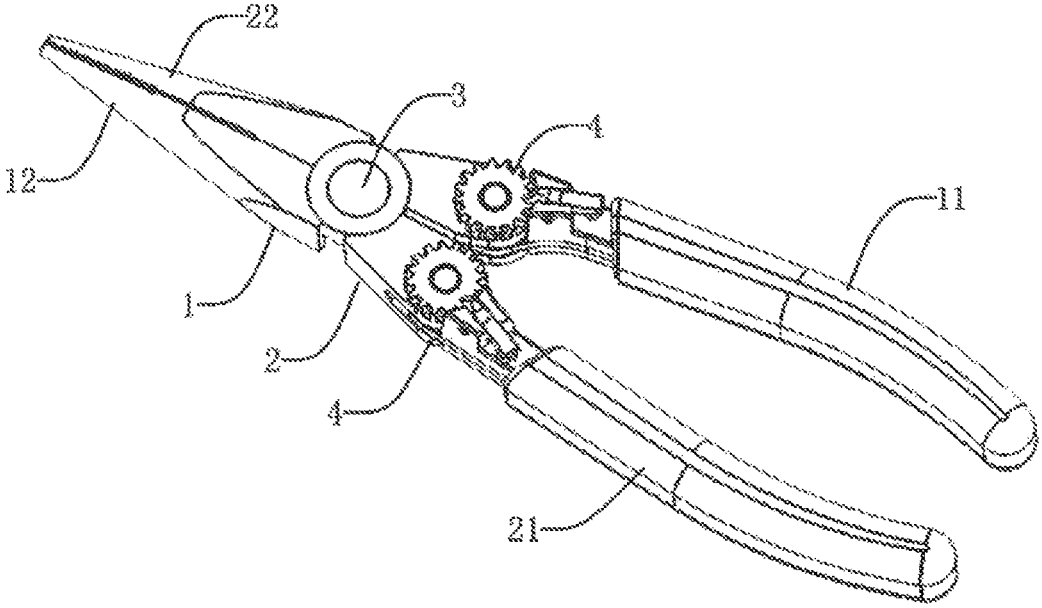
FIG. 15 is an overall structural schematic view of an open-close handheld apparatus in Example 3 of the invention.
Figure 16:
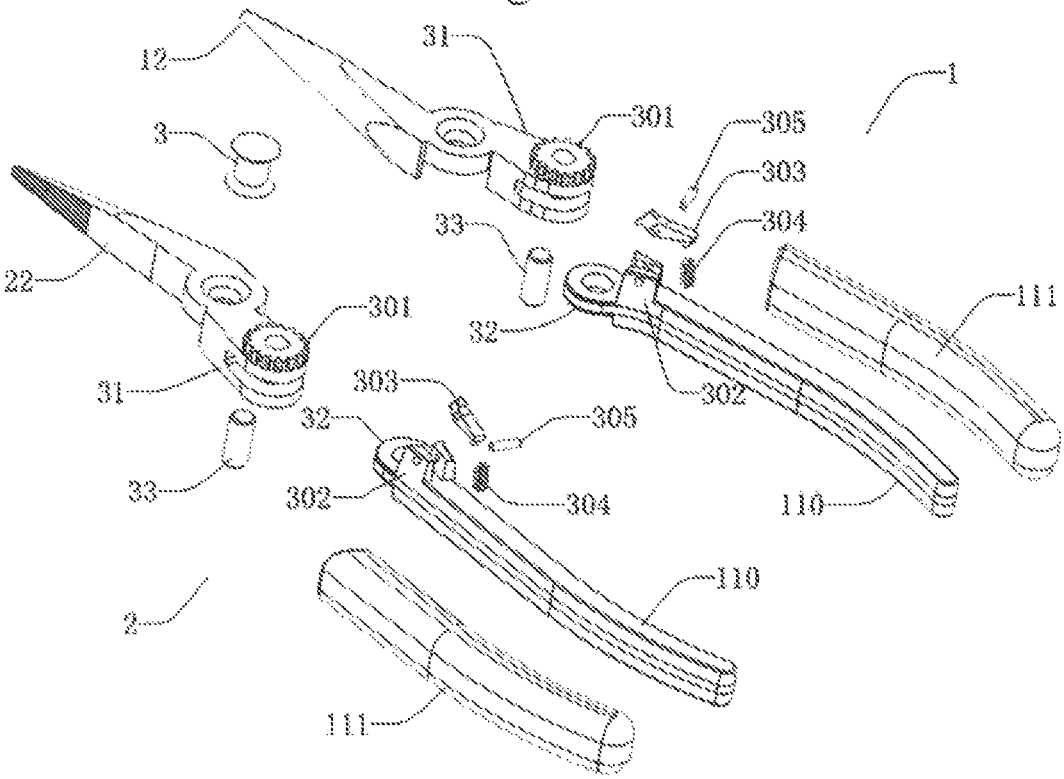
FIG. 16 is an exploded structural schematic view of an open-close handheld apparatus in Example 3 of the invention.
Figure 17:
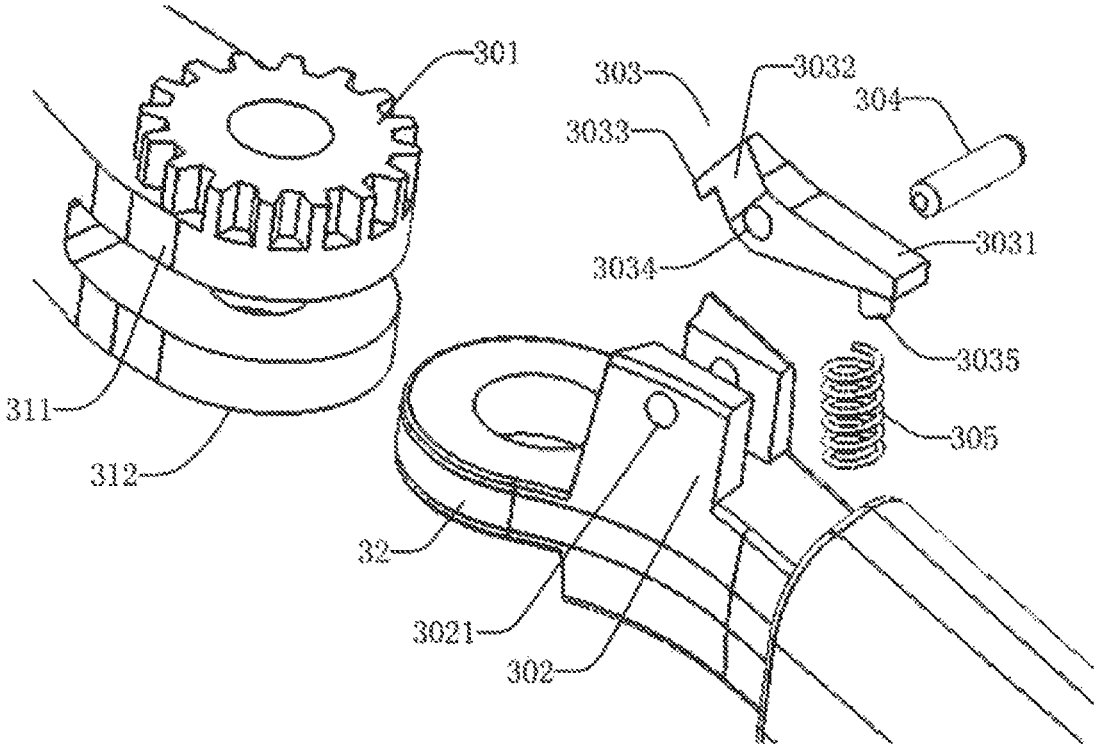
FIG. 17 is an exploded structural schematic view of the locking arrangement in Example 3 of the invention.

As shown in FIGS. 15-17, Embodiment 3 provides another open-close handheld apparatus, specifically, a pair of nipper pliers, which includes most of the technical schemes in Embodiment 1, and the locking arrangement 4 thereof includes an extending portion 31, a protruding portion 32 and a second axle pin 33, and the structural function and principle are the same as the embodiment, which will not be described here. In addition, the open-close handheld apparatus in Embodiment 3, compared with Embodiment 1, has the following distinguishing technical features: the locking arrangement 4 including a circular gear 301, two oppositely arranged mounting bases 302, a press snap button 303, a third axle pin 304 and a third spring 305.

The circular gear 301 protrudes from the upper surface of the first mounting plate 311. The circular gear 301 is fixed to the first mounting plate 311, or is integrally arranged with the first mounting plate 311.

The two oppositely arranged mounting bases 302 protrude from the upper surface of the first handheld portion 11 and/or the second handheld portion 21, and is adjacent to the protruding portion 32. The two mounting bases 302 are respectively provided with a base axle pin hole 3021, and the two base axle pin holes 3021 lie in the same straight line.

The press snap button 303 is arranged between the two mounting bases 302, and the press snap button 303 includes a second press plate 3031, a snap engaging portion 3032 and a third rack 3033. One end of the second press plate 3031 adjacent to the protruding portion 32 is provided with a press plate axle pin 3034 lying in the same straight line with the two base axle pin holes 3021, and the other end thereof is provided with a third spring mounting shaft 3035 protruding from and perpendicular to the lower surface of the second press plate 3031. The snap engaging portion 3032 is provided at one end of the second press plate 3031 adjacent to the protruding portion 32, and the snap engaging portion 3032 forms an angle of 120-160 degrees with the second press plate 3031. The third rack 3033 is provided at the top part of the snap engaging portion 3032, and protrudes downward and directly facing the circular gear 301.

The third axle pin 304 is passed through the press plate axle pin hole 3034 and the two bases axle pin holes 3021 simultaneously.

The third spring 305 is sheathed on the outside of the third spring mounting shaft 3035. One end of the spring 305 is tangent to the lower surface of the second press plate 3031, and the other end thereof is tangent to the upper surfaces of the handheld portions 11, 21.

In the operation of this embodiment, in the normal state, the third spring 305 is in a relaxed state. The third rack 3033 is snapped into the circular gear 301, the locking arrangement 4 is held in the locked state, and the handheld portion 11/21 can be held fixed relative to the clamping portion 12/22.

When the second press plate 3031 is pressed downward, the third spring 305 is in the compressed state. The third rack 3033 is lifted upward and detached from the circular gear 301, the locking arrangement 4 is unlocked to be adjusted into the unlocked state, and the handheld portion 11/21 can rotate relative to the clamping portion 12/22, that is, the first handheld portion 11 rotates relative to the first clamping portion 12, or the second handheld portion 21 rotates relative to the second clamping portion 22.

After the completion of rotation, the second press plate 3031 is released, the third spring 305 is again in the relaxed state. The third rack 3033 is snap fitted to the circular gear 301, the locking arrangement 4 is reset to and held in the locked state, and the handheld portion 11/21 can be held fixed relative to the clamping portion 12/22.

The technical effect of Embodiment 3 lies in that, Embodiment 3 includes two handheld portions, one or two of which is rotatable relative to the clamping portion. Under some special conditions, for example, in the case when the space is limited or the clamping portions are excessively wide open, the user can adjust the angle of one or two handheld portion, so as to adjust the distance and the operation angle between the two handheld portions for facilitating the operation and the use. Relatively, the scheme where both of the angles of the two handheld portions are adjustable has a larger range of adjustable angle and a larger adjustable distance between the two handheld portions compared with the scheme where the angle of a single handheld portion is adjustable. The components in Embodiment 3 have simpler structure, lower processing cost, and are convenient to use with wider range of application compared with Embodiment 1.

Embodiment 4

Figure 18:
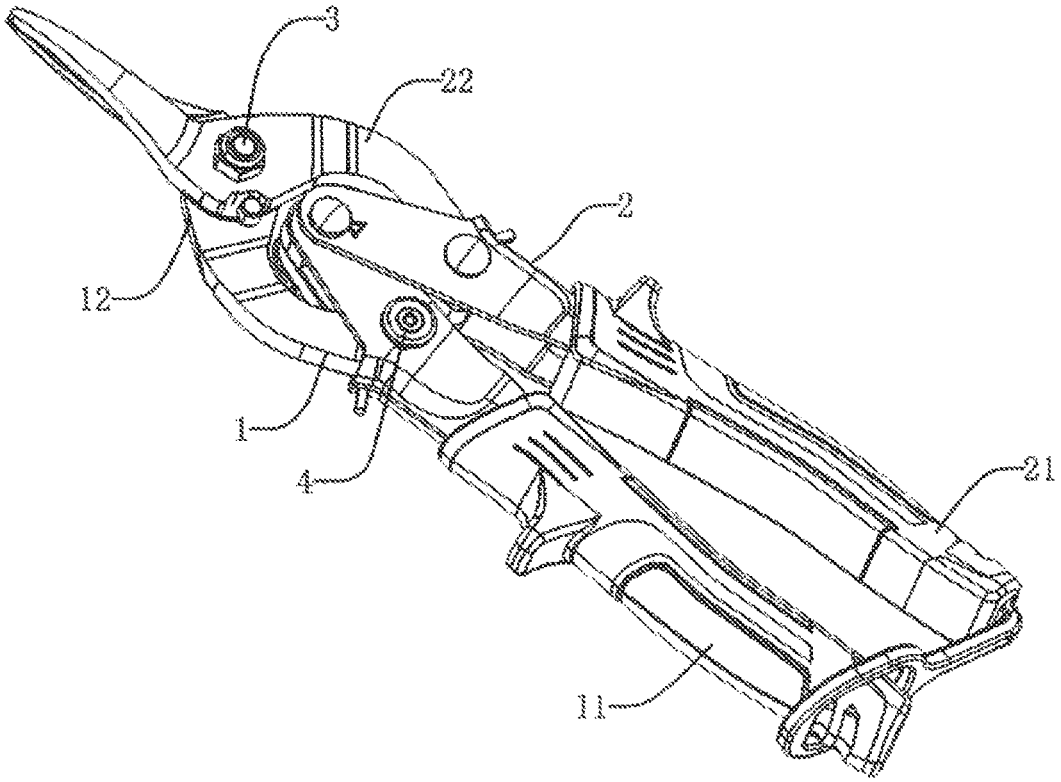
FIG. 18 is an overall structural schematic view of an open-close handheld apparatus in Example 4 of the invention.
Figure 19:
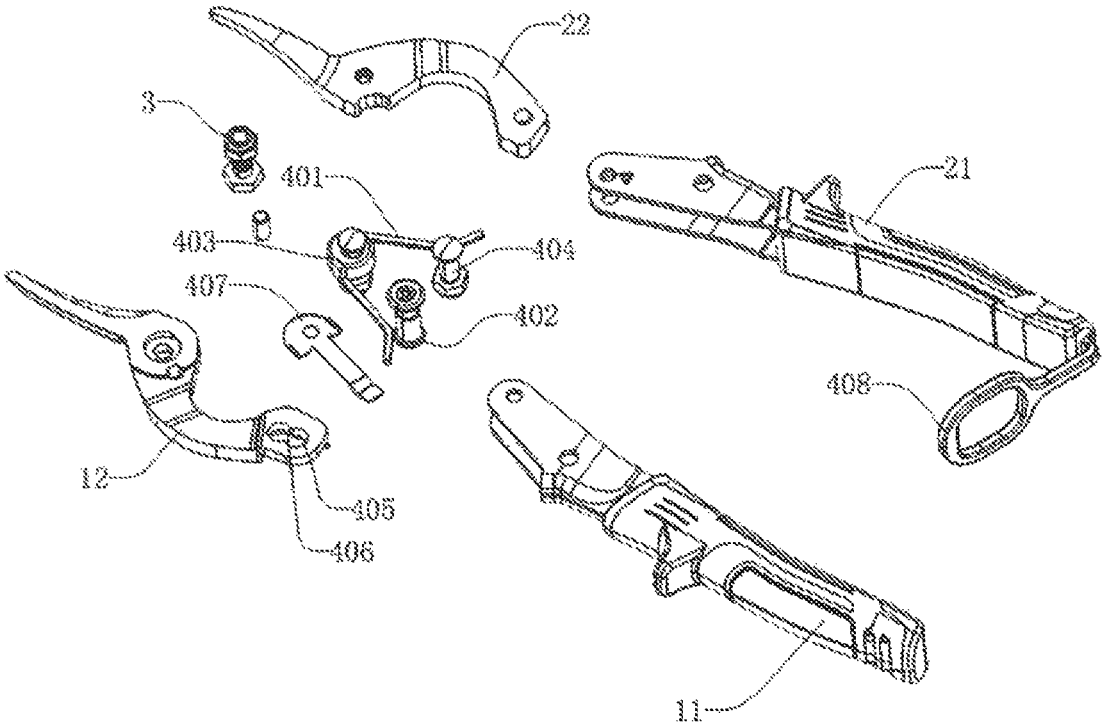
FIG. 19 is an exploded structural schematic view of an open-close handheld apparatus in Example 4 of the invention.

As shown in FIGS. 18-19, Embodiment 4 provides another open-close handheld apparatus, specifically, a pair of scissors, which includes part of the technical schemes in Embodiment 1, and the distinguishing technical features thereof compared with Embodiment 1 lie in that: the locking arrangement 4 does not include an extending portion 31, a protruding portion 32 and a second axle pin 33, instead includes an elastic support member 401, the cross-section of which is an inverted V-shape. The open-close handheld apparatus of the invention includes but not limited to the clamping means and cutting means, and the cutting means includes but not limited to scissors.

As shown in FIG. 19, in one embodiment, the locking arrangement 4 further includes a first sliding axle pin 402, a first fixation axle pin 403 and a second fixation axle pin 404.

The first sliding axle pin 402 is provided at the joint between the upper part of the first handheld portion 11 and the bottom end of the first clamping portion 12. The first fixation axle pin 403 is provided at the joint between the top end of the first handheld portion 11 and the top end of the second handheld portion 21. The first sliding axle pin 402 is slidably mounted to the first clamping portion 12. The second fixation axle pin 404 is provided at the joint between the upper part of the second handheld portion 21 and the bottom end of the second clamping portion 22.

The elastic support member 401 includes a first support arm 4011, a second support arm 4012 and an arc corner 4013. One end of the first support arm 4011 is passed through and fixed to the first handheld portion 11 and the first clamping portion 12, and the other end thereof is connected to the second support arm 4012. One end of the second support arm 4012 is passed through and fixed to the second handheld portion 21 and the second clamping portion 22, and the other end thereof is connected to the first support arm 4011. The arc corner 4013 is located at the joint between the first support arm 4011 and the second support arm 4012, and the inner side surface of the arc corner 4013 is tangent to the outer surface of the first fixation axle pin 403. The elastic support member 401 can assist the separation of the two clamping portions to be easily opened. In order to keep the two clamping portions in closed state, a fixation ring 408 can further be arranged at the bottom part of the handheld portion, for fixing the relative position of the two handheld portions when the open-close handheld apparatus is in the closed state.

When the two clamping portions are held in the relatively stationary state (the scissors in the closed state), a fixation axle pin is arranged at the joint between the handheld portion and the clamping portion, so that the handheld portion and the clamping portion cannot rotate relative to each other, and once the rotation occurs, it will result in separation of the two clamping portions from each other (the scissors in the open state). When the two clamping portions are held in a relatively stationary state, a sliding axle pin is arranged at the joint between the handheld portion and the clamping portion, so that the handheld portion and the clamping portion can rotate relative to each other within a certain range of angle.

In an alternative embodiment, the locking arrangement 4 includes a first sliding axle pin 402, a first fixation axle pin 403 and a second sliding axle pin (not shown). The second sliding axle pin has the same structure as the first sliding axle pin 402. The first sliding axle pin 402 is provided at the joint between the upper part of the first handheld portion 11 and the bottom end of the first clamping portion 12. The first fixation axle pin 403 is provided at the joint between the top end of the first handheld portion 11 and the top end of the second handheld portion 21. The second sliding axle pin is provided at the joint between the upper part of the second handheld portion 21 and the bottom end of the second clamping portion 22. The first sliding axle pin 403 is slidably mounted to the first clamping portion 12. The second sliding axle pin is slidably mounted to the second clamping portion 22. When the two clamping portions are held in a relatively stationary state, one sliding axle pin is respectively arranged at the joints between the two sets of handheld portions and the clamping portions, so that the two sets of handheld portions and the clamping portions can rotate relative to each other within a certain range of angle, and the adjustment range thereof is wider compared with that in the former embodiment.

Figure 20:
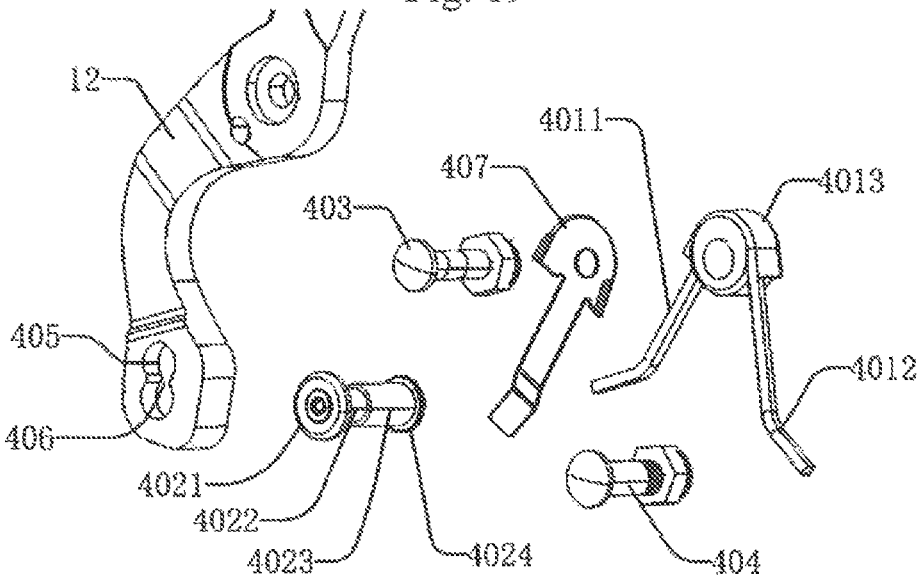
FIG. 20 is a structural schematic view of an open-close handheld apparatus in Example 4 of the invention.

As shown in FIG. 20, the first sliding axle pin 402 or the second sliding axle pin (not shown) successively includes a third press plate 4021, a thin shaft portion 4022, a thick shaft portion 4023 and an axle pin base 4024 that are connected with each other. The third press plate 4021 and the axle pin base 4024 protrude from the outside of the first handheld portion 11 or the second handheld portion 21. As shown in FIG. 19, the locking arrangement 4 further includes more than two location holes 405 that are communicated with each other and at least one sliding opening 406. More than two location holes 405 that are communicated with each other are provided at the bottom end of the first clamping portion 12 and/or the second clamping portion 22. The first sliding axle pin 402 and/or the second sliding axle pin 404 are/is slidably mounted into the location holes 405. Each sliding opening 406 is provided at the communication location between two adjacent location holes. The locking arrangement 4 further includes one or two interlocking plate 407, one end of which is connected to the first fixation axle pin 403, and the other end of which is connected to the axle pin base(s) 4024 of the first sliding axle pin 402 and/or the second sliding axle pin 404.

In the normal state, the thick shaft portion 4023 is located inside one location hole 405, and the locking arrangement 4 is in the locked state. The thick shaft portion 4023 enables the handheld portions 11, 21 to be fixed relative to the clamping portions 12, 22 since the diameter of the thick shaft portion 4023 corresponds to that of the location hole 405, and the locking arrangement 4 is in the locked state. When the third press plate 4021 is pressed downward, the interlocking plate 407 is deformed, and the thick shaft portion 4023 detaches from one of the location holes 405. The locking arrangement 4 is unlocked to be adjusted into the unlocked state. The thin shaft portion 4022 is passed through a sliding opening 406 between two location holes 405 and slides to a next location hole 405 since the diameter of the thin shaft portion 4022 corresponds to the width of the sliding opening 406. When the third press plate 4021 is released, the interlocking plate 407 recovers from deformation, the thick shaft portion 4023 enters and is snapped into a next location hole 405, and the locking arrangement 4 is again in the locked state.

The technical effect of Embodiment 4 lies in that Embodiment 4 includes two handheld portions, and one or two of the handheld portions can rotate relative to the clamping portion when the two clamping portions are held in a relatively stationary state, so that the angle of one or two handles of the scissors can be adjusted. Under some special conditions, for example, in the case when the space is limited or the clamping portions are excessively wide open, the user can adjust the angle of one or two handheld portion, so as to adjust the distance and the operation angle between the two handheld portions to be adapted to the hand shape and using habit of the user, facilitating the operation and use. Relatively, the scheme where both of the angles of the two handheld portions are adjustable has a larger range of adjustable angle and a larger adjustable distance between the two handheld portions compared with the scheme where the angle of a single handheld portion is adjustable.

Embodiment 5

Figure 21:
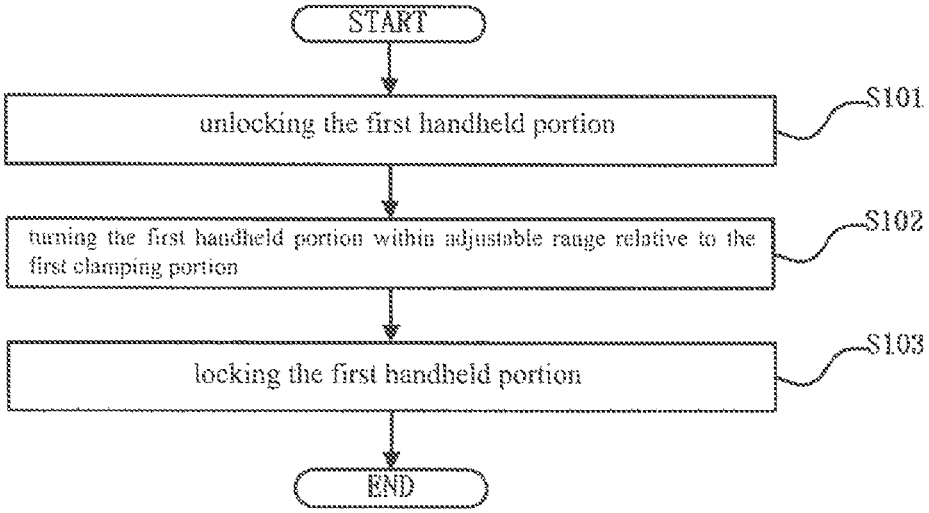
FIG. 21 is a flow chart of a method of adjustment of the angle between the handheld potions of an open-close handheld apparatus in Example 5 of the invention.

As shown in FIG. 21, Embodiment 5 provides a method of adjustment of the angle between the handheld portions of another open-close handheld apparatus according to any one in Embodiments 1 to 4, the method specifically including the following steps:

Step S101: unlocking the first handheld portion. The locking arrangement of the first handheld portion in the open-close handheld apparatus according to any one in Embodiments 1 to 4 is opened to change it from the locked state into the unlocked state.

Step S102: turning the first handheld portion within an adjustable range relative to the first clamping portion, wherein the plane in which the rotation path of the first handheld portion is located is the same as or parallel to the open-close plane. In this step the angle and distance between the two handheld portions can be adjusted to adapt to the limitation of the operational space and operation habit of the user. The adjustable range in Embodiments 1 to 3 is from 0 to 90 degrees turning toward left or right, and in Embodiment 4 it is the angle range limited by a plurality of location holes, where the specific range is determined by the number of the location holes.

Step S103: locking the first handheld portion. The locking arrangement of the first handheld portion in the open-close handheld apparatus according to any one in Embodiments 1 to 4 is re-adjusted into the locked state.

Before using the open-close handheld apparatus, the angle adjustment method in Steps S101 to S103 are adopted to adjust the angle of the handheld portion at one side thereof so as to change the angle between the handheld portion and the clamping portion at the one side and to change the distance between two handheld portions, so as to adapt to the user's habit of using tools, and the user's operation can be more effort saving and the open-close handheld apparatus is preferably adapted to different situations.

Figure 22:
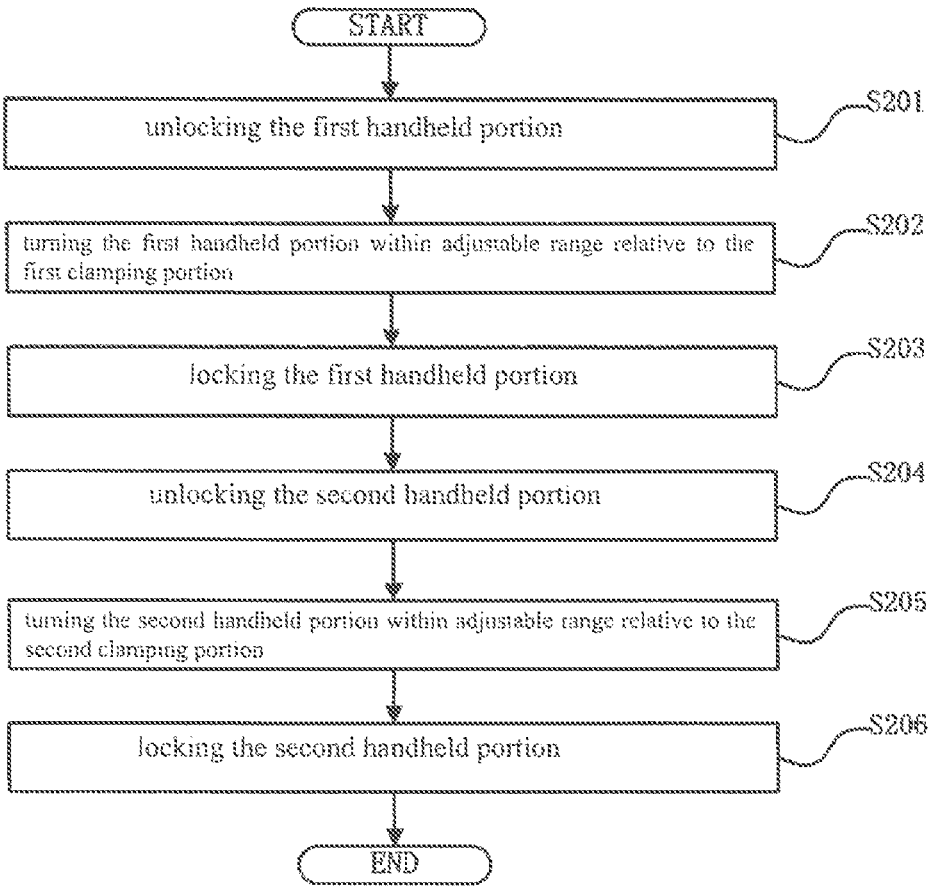
FIG. 22 is a flow chart of another method of adjustment of the angle between the handheld potions of an open-close handheld apparatus in Example 5 of the invention.

As shown in FIG. 22, Embodiment 5 further provides another method of adjustment of the angle between the handheld portions of the open-close handheld apparatus according to any one in Embodiments 1 to 4, the method specifically including the following steps:

Step S201: unlocking the first handheld portion. The locking arrangement of the first handheld portion in the open-close handheld apparatus according to any one in Embodiments 1 to 4 is opened to change it from the locked state into the unlocked state.

Step S202: turning the first handheld portion within an adjustable range relative to the first clamping portion, wherein the plane in which the rotation path of the first handheld portion is located is the same as or parallel to the open-close plane.

In this step the angle and distance between the two handheld portions can be adjusted to adapt to the limitation of the operational space and operatiZon habit of the user. The adjustable range in Embodiments 1 to 3 is from 0 to 90 degrees turning toward left or right, and in Embodiment 4 it is the angle range limited by a plurality of location holes, where the specific range is determined by the number of the location holes.

Step S203: locking the first handheld portion. The locking arrangement of the first handheld portion in the open-close handheld apparatus according to any one in Embodiments 1 to 4 is re-adjusted into the locked state.

Step S204: unlocking the second handheld portion. The locking arrangement of the second handheld portion in the open-close handheld apparatus according to any one in Embodiments 1 to 4 is re-adjusted into the unlocked state.

Step S205: turning the second handheld portion within an adjustable range relative to the second clamping portion, wherein the plane in which the rotation path of the second handheld portion is located is the same as or parallel to the open-close plane. In this step the angle and distance between the two handheld portions can be adjusted to adapt to the limitation of the operational space and operation habit of the user. The adjustable range in Embodiments 1 to 3 is from 0 to 90 degrees turning toward left or right, and in Embodiment 4 it is the angle range limited by a plurality of location holes, where the specific range is determined by the number of the location holes.

Step S206: locking the second handheld portion. The locking arrangement of the second handheld portion in the open-close handheld apparatus according to any one in Embodiments 1 to 4 is re-adjusted into the locked state.

Before using the open-close handheld apparatus, the angle adjustment method in Steps S201 to S206 is adopted to adjust the angle of the handheld portion at both sides thereof so as to change the angle between the handheld portion and the clamping portion at the both sides and to change the distance between two handheld portions, so as to adapt to the user's habit of using tools, and the user's operation can be more effort saving and the open-close handheld apparatus is preferably adapted to different operation conditions.

The advantage of the invention lies in that an open-close handheld apparatus and a method of adjustment of the angle between the handheld portions thereof are provided, and the user can autonomously adjust the relative angle between the handheld portion and the clamping portion of the handheld tool in the open-close direction according to the size of the use's hand and the habit of exerting force and lock the handheld tool, so that the user can operate and use the handheld tool in an angle which is most familiar to the users and most convenient to use.

Under some special application conditions, for example, when the volume of the object to be clamped is relatively large, the angle between the clamping portions therefore is relatively large, yet the angle between the handheld portions can then be adjusted to a proper position so that the distance between the two ends of the two opened handheld portions is relatively small, and the user can exert force with a single hand to the ends of the two handheld portions so as to complete the operation smoothly, which is more effort saving compared with normal open-close apparatus.

The preferred specific embodiments of the invention have been described in detail above. It is to be understood that numerous modifications and variations can be made by those ordinary skilled in the art in accordance with the concepts of the present invention without any inventive effort. Hence, the technical solutions that may be derived by those skilled in the art according to the concepts of the present invention on the basis of the prior art through logical analysis, reasoning and limited experiments should be within the scope of protection defined by the claims.

The invention claimed is:

1. An open-close handheld apparatus, comprising a first member and a second member, the first member comprises a first clamping portion and a first handheld portion;

the second member comprises a second clamping portion and a second handheld portion, the first and second clamping portions are rotatably and movably connected via a first axle pin, the first and second clamping portions open and close relative to each other, wherein the first handheld portion is rotatably connected to the first clamping portion, a locking arrangement is provided at a joint between the first handheld portion and the first clamping portion, used for locking or unlocking the first handheld portion and the first clamping portion wherein the second handheld portion is rotatably connected to the second clamping portion, a locking arrangement is provided at the joint between the second handheld portion and the second clamping portion, used for locking or unlocking the second handheld portion and the second clamping portion;

wherein the locking arrangement comprises:

an extending portion, provided at the bottom end of the first and second clamping portion, a protruding portion, provided at the top end of the first and second handheld portion and inserted into the extending portion, a second axle pin, passing through the extending portion and the protruding portion;

wherein the protruding portion is movably connected to the extending portion via the second axle pin;

wherein the extending portion comprises:

a first mounting plate, a second mounting plate oppositely arranged relative to the first mounting plate, an assembly groove provided between the first mounting plate and the second mounting plate, used for inserting into the protruding portion;

wherein the first mounting plate comprises a first mounting hole, the second mounting plate comprises a second mounting hole oppositely arranged relative to the first mounting hole, the protruding portion comprises a third mounting hole, when the protruding portion is inserted into the assembly groove, the second axle pin successively passes through the first mounting hole, the third mounting hole and the second mounting hole;

wherein the locking arrangement further comprises:

a first semi-circular gear formed at an end of the first mounting plate, a second semi-circular gear formed at an end of the second mounting plate, a first stop block protruding from an upper surface of the first handheld portion and being adjacent to the protruding portion of the first handheld, a second stop block protruding from an upper surface of the second handheld portion and being adjacent to the protruding portion of the second handheld, the stop block provided with a U-shaped groove opening facing the semi-circular gear of the corresponding clamping portion, the bottom part of the U-shaped groove provided with a first spring mounting groove, a sliding snap button arranged in the U-shaped groove, the sliding snap used for matching with one of the first semi-circular gear and the second semi-circular gear, the sliding snap button comprises:

a snap button body, the shape thereof corresponding to the shape of the bottom part of the U-shaped groove, being perpendicular to the protruding portion, a snap button dial knob, provided above the snap button body, protruding from the upper surface of the first handheld portion and the upper surface of the second handheld portion, a rack protruding from a side wall of the snap button body facing a side of the semi-circular gear, the rack used for matching with one of the first semi-circular gear and the second semi-circular gear, the rack being perpendicular to the protruding portion, the length of the rack corresponding to that of the snap button body, a second spring mounting shaft provided on a side wall of the snap button body facing a side of the spring mounting groove, the second spring mounting shaft being parallel to the protruding portion, the second spring mounting shaft and the spring mounting groove lying in the same straight line, a second spring sheathed on the second spring mounting shaft, one end of the second spring being tangent to the snap button body, the other end thereof being located in the spring mounting groove.

2. A method of adjustment of the angle between the handheld portions of the open-close handheld apparatus as claimed in claim 1, wherein the method comprises the following steps:

unlocking the first handheld portion, turning the first handheld portion relative to the first clamping portion, locking the first handheld portion.

3. A method of adjustment of the angle between the handheld portions of the open-close handheld apparatus as claimed in claim 1, wherein the method comprises the following steps:

unlocking the first handheld portion, turning the first handheld portion relative to the first clamping portion, locking the first handheld portion, unlocking the second handheld portion, turning the second handheld portion relative to the second clamping portion, locking the second handheld portion.

* * * * *